United States Patent [19]

Badger et al.

[11] 4,043,165

[45] Aug. 23, 1977

[54] THREE-POINT, AIR-BENDING SHEET METAL BENDER

[75] Inventors: Douglas V. Badger, Federal Way; Ralph Y. Lewis, Kent, both of Wash.

[73] Assignee: The Boeing Company, Seattle, Wash.

[21] Appl. No.: 723,321

[22] Filed: Sept. 15, 1976

[51] Int. Cl.[2] ..... B21D 5/00

[52] U.S. Cl. ..... 72/307; 72/384; 72/388

[58] Field of Search ..... 72/307, 380, 381, 384, 72/385, 387, 388, 306, DIG. 16, 416

[56] References Cited

U.S. PATENT DOCUMENTS

| | | | |
|---|---|---|---|
| 1,808,019 | 6/1931 | Clausing | 72/388 |
| 3,430,476 | 3/1969 | Duda | 72/385 |

FOREIGN PATENT DOCUMENTS

| | | | |
|---|---|---|---|
| 89,745 | 8/1957 | Norway | 72/388 |

*Primary Examiner*—Lowell A. Larson
*Attorney, Agent, or Firm*—Christensen, O'Connor, Garrison & Havelka

[57] ABSTRACT

A three-point, air-bending sheet metal bender comprising a pair of elongated U-shaped finger dies mounted parallel to one another is disclosed. The elongated finger dies are mirror images of one another (when appropriately aligned) and, prior to bending, are spaced from each other by an amount generally equal to the thickness of the sheet of metal to be bent. The elongated finger dies are laterally position adjustable such that the "finger" of one die is alignable with the "palm" of the other die and vice versa; i.e., the finger of each die is alignable with the palm of the other die. During bending, the "finger" die remains fixed and the "palm" die rotates. As the palm die rotates, sheet metal located between the two dies is bent. The direction of bending, with respect to the plane of the sheet of metal prior to bending, is determined by the die that is chosen to rotate. A part support table is provided for supporting sheet metal parts and moving them into the space between the two finger dies prior to bending. The part support table is arcuately movable in the plane of part insertion such that the part can be moved between the dies along axes transverse to the longitudinal axis of the finger dies, other than an orthogonal axis. By sequentially moving the part through the dies, with a bend being performed subsequent to each such movement, a complex array of bends may be formed in a part prior to ejection from the bender.

19 Claims, 9 Drawing Figures

Fig. 6A.
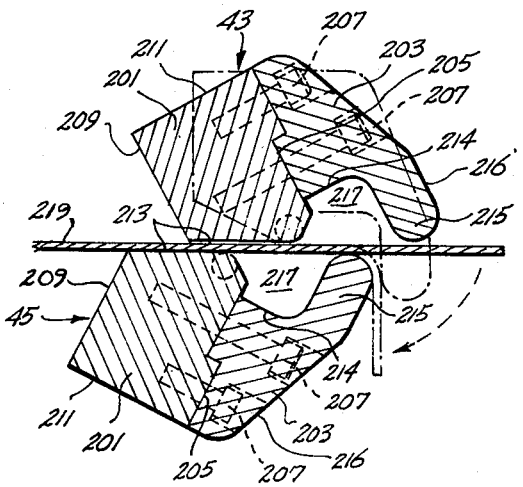
Fig. 6B.
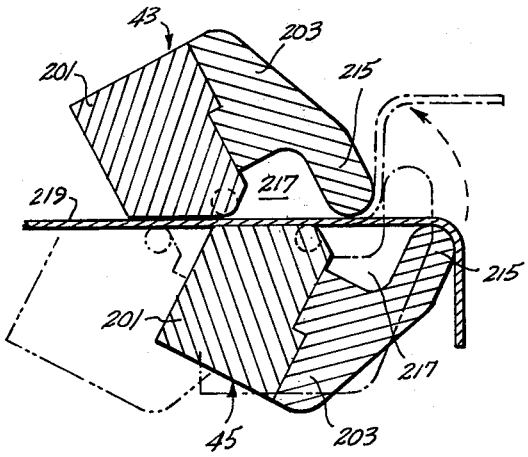
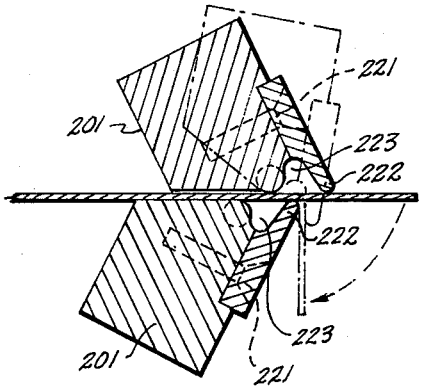
Fig. 7.
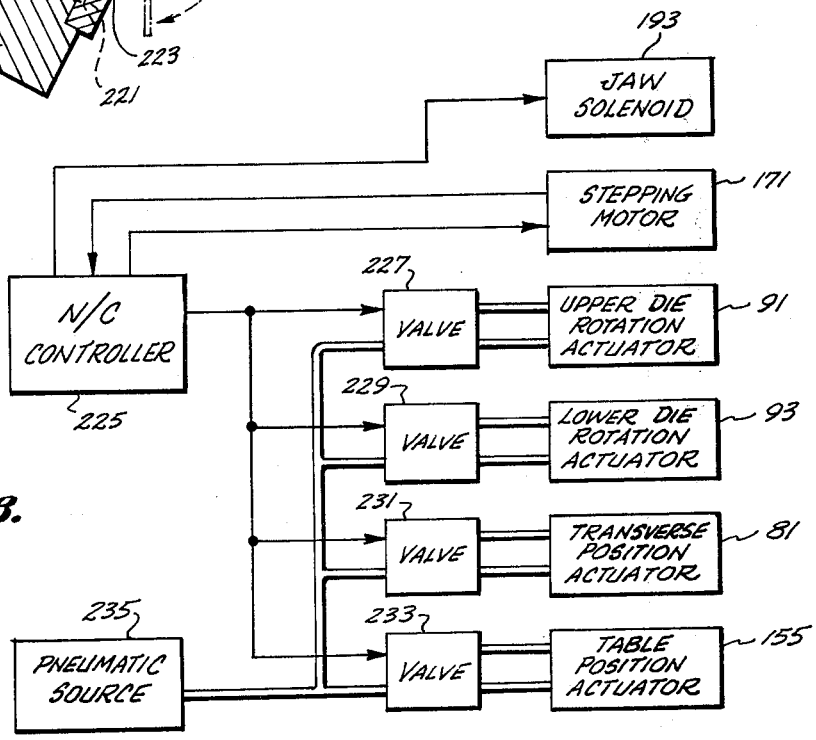
Fig. 8.

THREE-POINT, AIR-BENDING SHEET METAL BENDER

BACKGROUND OF THE INVENTION

This invention is directed to bending and, more particularly, to bending sheet metal parts.

The production of sheet metal parts is well known. Such parts are used for a variety of purposes. They may be utilized to join longitudinal elements such as stringers and girders end-to-end. They may be utilized to attach girders to stringers, attach sheets of metal to girders and stringers or for a variety of other purposes.

The amount of sheet metal parts produced during a single production run varies from a few to several million, depending upon the industry involved. When the number to be produced in a production run, or a series of production runs, is relatively high i.e., in the order of hundreds of thousands or millions, the production of expensive stamp dies is justified. However, when a smaller number of parts are to be produced i.e., hundreds or thousands, the expense of producing such dies may not be justified. In such instances, other metal bending devices using non-specialized dies are generally utilized. The present invention finds its primary use in such environments.

In the past, limited production runs of parts have usually been made in press brakes using Vee dies and punches by a skilled operator placing the part to be formed in a particular position and then operating a punch. While being versatile, press brakes have a number of disadvantages. First, the whole part is in motion during the bending operation, which makes automatic registration of a second bend extremely difficult. Thus, skilled operators are a necessity. Second, the motion of the part, which is adjacent to the operator, may present a safety problem. Third, conventional tooling is capable of bending in one direction only. Thus, to make a Z-angle or return flange bend, the part or workpiece must be removed from the machine and inverted after the first bend is made in order for the second bend to be made. The end result of these disadvantages is that the production of sheet metal parts utilizing press brakes is time consuming and expensive. Moreover, such machines are relatively unsuitable for automation, primarily due to the complex path through which a part must be moved as it is being formed, particularly when return flange structures are being formed.

Leaf brakes and bar folders have also been utilized to bend sheet metal parts. Because such bending machines maintain one edge of the part stationary during the bending cycle, they are more amenable to automation. However, these bending machines have other disadvantages. Specifically, conventional types of leaf brakes and bar folders create non-uniform bend radii and have a tendency to mark the surface of sheet metal as it is being bent. More specifically, leaf brakes and bar folders bend sheet metal by clamping the metal part between a jaw and a punch (or folding blade) and, then, rotating the clamping structure to bend the workpiece. The rotation pivot point is approximately located at either the center line of the punch radius, or the outer mold line of the part. Because of this location, the rotation action creates a "wiping" motion that often results in the marking of the surface of the part, and a non-uniform bend radius. Thus, while the skill involved in utilizing leaf brakes and bar folders is less than the skill involved in utilizing Vee die press brakes, other disadvantages exist.

Therefore, it is an object of this invention to provide a new and improved sheet metal bender.

It is a further object of this invention to provide a new and improved sheet metal bender suitable for bending sheet metal parts in either direction without requiring that the part be inverted subsequent to bending in one direction.

It is another object of this invention to provide a sheet metal bender that bends sheet metal parts with a minimal amount of marking of the surface of the part.

It is a still further object of this invention to provide a sheet metal bender adapted to bend sheet metal parts such that they have a substantially uniform bend radius.

SUMMARY OF THE INVENTION

In accordance with principles of this invention a sheet metal bender including a pair of elongated finger dies is provided. The elongated finger dies, when viewed in cross section, are generally U-shaped, with one leg of the U forming a finger and the longitudinal aperture forming a palm. The finger dies are positioned such that the fingers and palms face one another, on opposite sides of a plane in which the metal part to be bent is moved. The facing is such that the dies are mirror images of one another when their fingers and palms are aligned. Prior to bending, the dies are spaced by an amount generally equivalent to the thickness of the metal part to be bent. The dies are laterally position adjustable such that the finger of either die is alignable with the palm of the other die, the actual lateral position being dependent upon the desired direction of bend. After being so positioned, the palm die is rotated about the finger of the finger die and bends a part located between the dies. The dies are formed such that three-point, air-bending occurs as the palm die is rotated. The threepoints of bending are the two legs of the palm die (its finger and the other leg of the U-shape) and the finger of the finger die. If the dies are repositioned subsequent to a bend in one direction, such that the former finger die now forms the palm die and the former palm die now forms the finger die, rotation of the new palm die about the new finger die causes a bend in the opposite direction, whereby Z's and return flange parts are readily formed.

In accordance with further principles of this invention, a table having its upper surface coplanar with the plane of travel of the part between the dies is provided. The table is adapted to support the outer tip of the parts during bending and control the position of the part between the dies. The table is angularly adjustable in the plane of part movement such that parts can be moved orthogonally, or through a chosen transverse angle with respect to the longitudinal axes of the dies. Preferably, the table includes a stepping motor adapted to sequentially move the part from a predetermined start position through the dies so that different regions of the part are sequentially positioned at different positions between the dies, at each of these predetermined positions a bend is formed. The nature of the bends, of course, are determined by the desired shape of the resultant part.

In its preferred form, the apparatus of the invention includes a base structure and a pair of parallel walls extending upwardly therefrom. The dies are mounted between the parallel walls. One of the dies is mounted between a pair of relatively large circular discs so as to be rotated as the discs are rotated. The discs include arcuate apertures through which the other die passes. The other die is also rotatably mounted. Further, the other die is mounted for lateral movement. Preferably, hydraulic mechanisms are provided for: (1) rotating the die attached to the relatively large discs; (2) rotating the other die; (3) position adjusting the other die; and, (4) transversely position adjusting the table.

It will be appreciated from the foregoing brief summary that the invention is a three-point, air-bending sheet metal bender that overcomes the disadvantages of prior art benders, discussed above. In operation, a palm die is revolved about a forming radius defined by the radius of a finger of a finger die to form a single bend in one direction, or multiple bends in the same direction if the part is sequentially moved subsequent to each bend. Shifting the pivot of the palm die with respect to the finger die causes the dies to shift functions. Revolving the new palm die about the new finger die, causes bends to form in the opposite direction. Bends are formed in either direction without requiring that the part be inverted, or even removed from the bender.

Because the invention utilizes a three-point bending load rather than a wiping action of the type created by a leaf brake or bar folder, the disadvantages of marking the surface of the part and the production of parts with non-uniform bend radii are eliminated. Specifically, the pivoting of dies about a forming radii (finger) results in the radii of the formed part being more uniform and minimum movement of the part with respect to the dies. Further, very little clamping action of the part is required. In fact, the only clamping action required is a clamp force adequate to maintain the part in position at the start of bending. Thereafter, because the part is relatively unloaded, except in the region of bending, very little further clamping force is required.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIGS. 6A and 6B are cross-sectional views of finger dies in first and second positions;

FIG. 7 is a cross-sectional view of an alternate form of a finger die, particularly suitable for making smaller radii curves, in a first position; and, FIG. 8 is a schematic diagram illustrating a control system for controlling the mechanical structure illustrated in FIG. 1.

DESCRIPTION OF THE PREFERRED EMBODIMENTS

Figure 1:
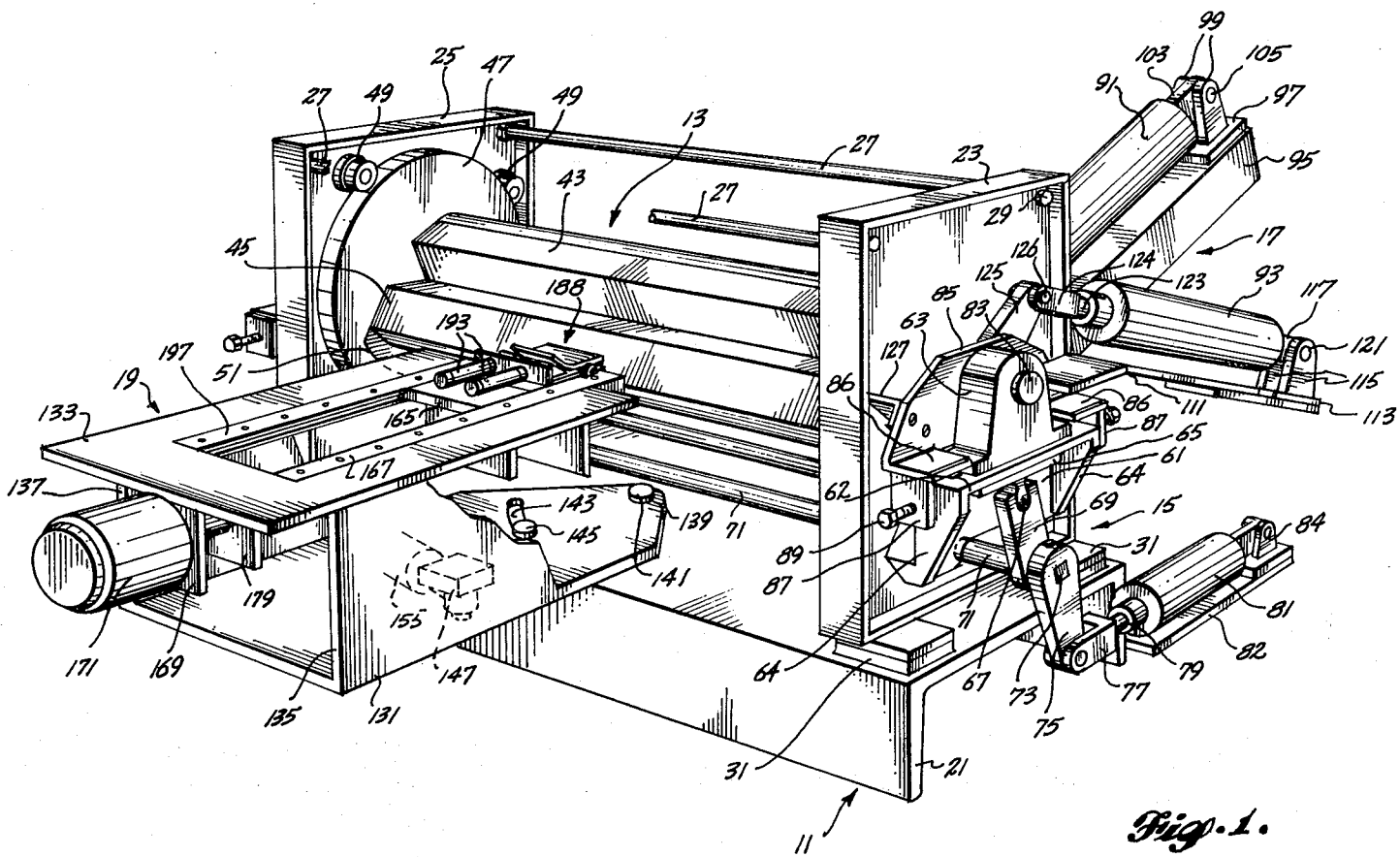
FIG. 1 is a pictorial view of a preferred embodiment of the invention.

FIG. 1 illustrates a preferred embodiment of a three-point, air-bending sheet metal bender formed in accordance with the invention and comprises: a frame 11; a die assembly 13; a die transverse positioning assembly 15; a die rotation control mechanism 17; and, a table assembly 19.

The frame 11 comprises a base member 21 illustrated as an inverted U-channel; and, a pair of upwardly extending walls 23 and 25. The walls are located at either end of the base member 21, in planes transverse to the longitudinal axis of the U-channel. While the walls may be affixed to the base plate 21 in any suitable manner, they are illustrated as spaced above the base plate 21 by spacers 31, which are welded to the base plate 21 and to the walls 23 and 25.

Extending between the walls 23 and 25 are a plurality of spaced support rods 27. The spaced support rods may, for example, comprise inner rods threaded at either end surrounded by pipes. Nuts 29 located on the outer faces of the walls 23 and 25 press the walls toward one another against the spreading action of the pipes, whereby a rigid structure is provided. Obviously, other types of rod strengthening arrangements can be used, if desired.

The die assembly 13 comprises first and second finger dies 43 and 45, illustrated as upper and lower finger dies, respectively. The cross-sectional nature of the dies is illustrated best in FIGS. 4, **6*a*, 6*b* and 7 and is hereinafter described. The upper die 43 is affixed at either end to one of a pair of circular discs 47, only one of which can be viewed in FIG. 1. The discs 47 lie flat generally against the inner surface of the walls 23 and 25, one against each wall, and are supported for rotation by a plurality of rollers 49. In order to reduce binding and friction, the discs may be spaced from the walls, by bearings, if desired. The rollers 49, of which at least three are included, are rotatably mounted on shafts affixed to their related walls and maintain the discs 47 in a predetermined lateral position. Thus, the upper or first die 43** is rotable, but not laterally position adjustable.

Figure 4:
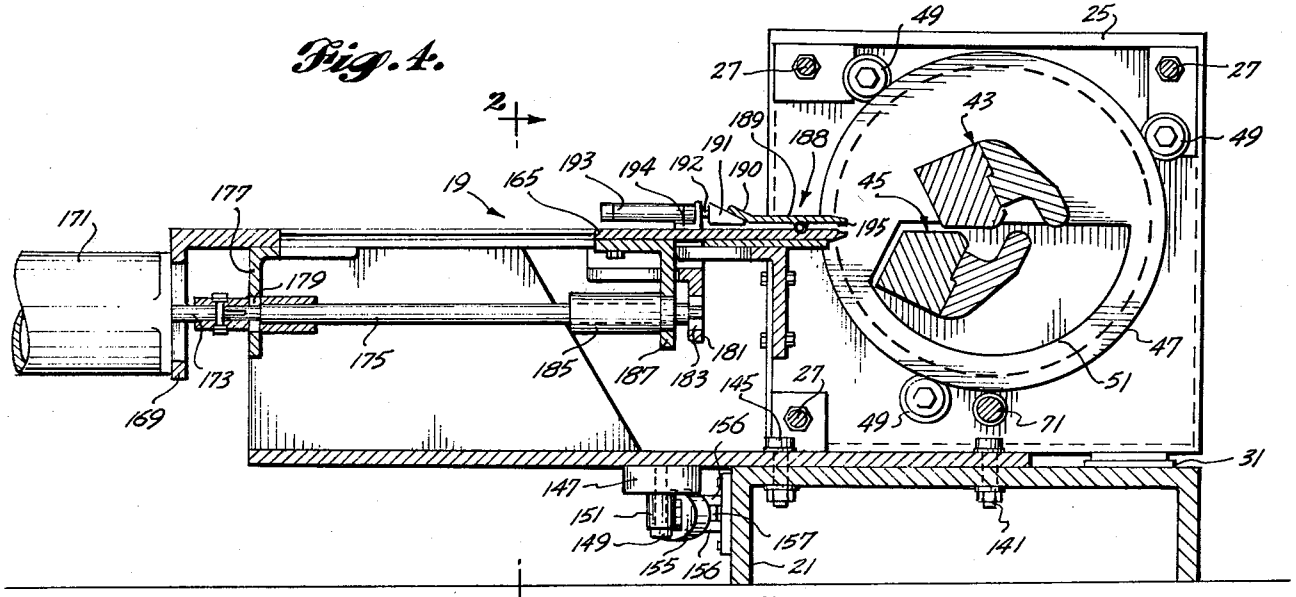
FIG. 4 is a cross-sectional view along line 4—4 of FIG. 2.
Figure 5:
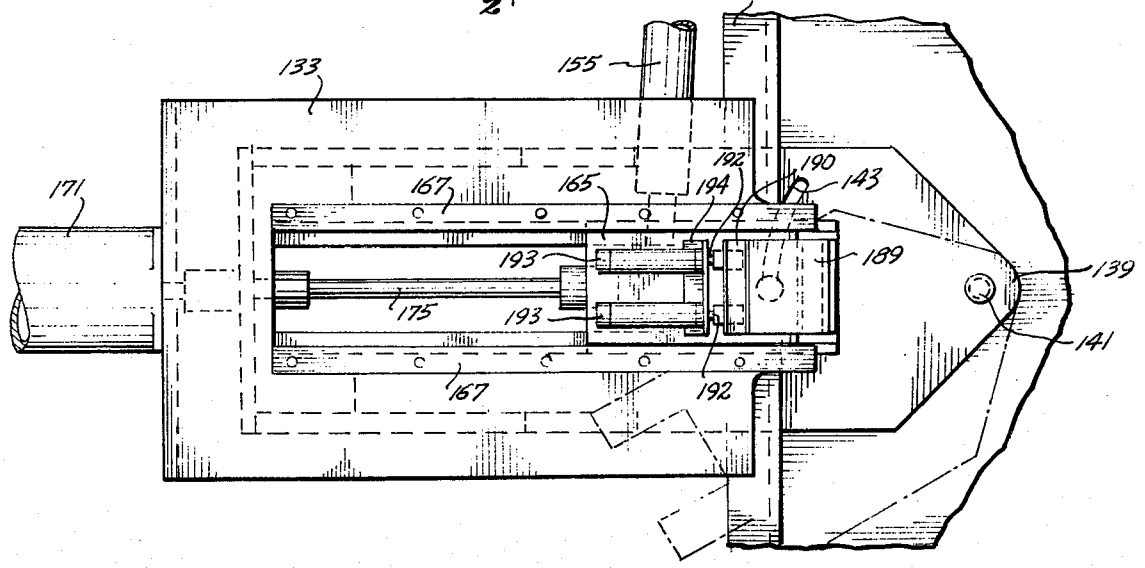
FIG. 5 is a plan view of the part support table illustrated in FIG. 1.

The second or lower die 45 passes through an arcuate aperture 51 located in the bottom portion of each circular disc 47, as best seen in FIG. 4. The arcuate aperture 51 is sized such that the second die 45 can be laterally moved back and forth, by the die transverse positioning assembly 15 hereinafter described, without preventing the rotation of either die through an arc lying in the 45°–60° range, when the dies are suitably positioned, as herein described. In any event, while the upper die 43 is laterally fixed, the lower die 45 is laterally position adjustable.

The die transverse positioning assembly 15 comprises a pair of shelf brackets 61, only one of which can be viewed in FIG. 1. The shelf brackets 61 are affixed to, and extend outwardly from, the first and second walls 23 and 25, respectively. The shelf brackets 61 include a horizontal shelf 62 and a vertical plate suitable for attachment to the associated wall by bolts or welding, for examples. Downwardly extending angle side wall 64, one located on either end of the shelf brackets 61 and extending between the associated horizontal shelf 62 and the vertical plate, brace the horizontal shelf. Each horizontal shelf includes a slot extending parallel to the associated wall, said slots being hidden from view in the drawings. The horizontal shelves 62 are positioned such that shaft apertures in shaft support hubs 63, mounted on the horizontal shelves in the manner hereinafter described, are adapted to receive shafts 83 affixed to either end of the lower die 45.

The shaft support hubs 63 include horizontally planar lower surfaces and ride on bearings (not shown) located between the lower surfaces of the shaft support hubs and the horizontal shelves 62 of the shelf brackets 61. A plate 65 is located beneath horizontal shelf 62 and attached to its related hub by a pair of bolts that pass through the above noted slots in the shelves. Thus, the hubs are prevented from moving vertically while remaining movable back and forth in a horizontal direction orthogonal to the axes of the dies. The plates 65 include downwardly projecting knuckle pins 67. The knuckle pins 67 fit into knuckle apertures formed in the end of yokes 69 mounted on the ends of a horizontal shaft 71. The horizontal shaft 71 is located beneath the knuckle pin 67 and rotatably supported in the walls 23 and 25. One of the outer ends 73 of the horizontal shaft is squared and attached to an arm 75. The arm is pinned to a first pneumatic actuator yoke 77. The first pneumatic actuator yoke 77 is affixed to the shaft 79 of a first pneumatic actuator 81. The first pneumatic actuator 81 is mounted generally orthogonal to the axis of the arm 75. More specifically, a support arm 82 projects outwardly from one leg of the base 21. Mounted atop the outer end of the support arm 82 is a second pneumatic actuator yoke 84 that is pinned to the non-shaft end of the first pneumatic actuator 81. The mounting and arrangement of the pins is such that movement of the shaft 79 inwardly or outwardly causes the arm 75 to move back and forth. Movement of the arm, in turn, rotates the horizontal shaft 71. This movement, via the knuckle yokes 69 and the knuckle pins 67 move the shaft hubs 63 laterally back and forth.

The die transverse positioning assembly also includes stop mechanisms. A stop mechanism is affixed to each shaft support hub 63 and, each such mechanism includes an angle plate 85 having a horizontal wall affixed to the related hub 63, between the hub and its related wall. The other or vertical wall of the angle plates 85 form arms 86 that lie on either side of the related shaft support hubs projecting downwardly from the arms 85 are stop brackets 87, one located on either end of the angle plate 85. The stop brackets lie outside of the angle side walls 64 of the shelf brackets 61 and in planes parallel thereto. Threaded through the stop brackets 87 are stop bolts 89. The stop bolts 89 are adapted to impinge on the angle side walls of the shelf brackets 61 to which they relate, when the first pneumatic actuator moves its related mechanism to extreme outboard positions, in one direction or the other. Thus, by rotating the bolts inwardly or outwardly, the amount of maximum lateral movement of the shaft support hubs 63 and, consequently, the second die 45 can be controlled.

Figure 3:
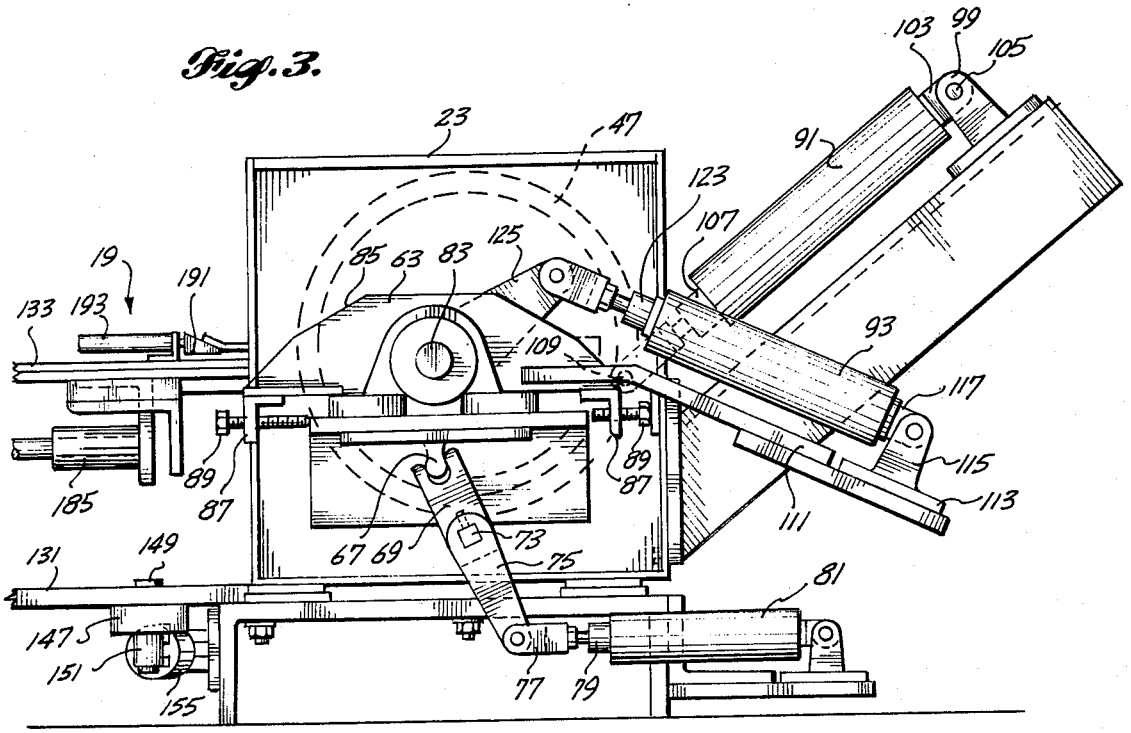
FIG. 3 is an end view of the preferred embodiment of the invention illustrated in FIG. 1.

The die rotation control mechanism 17 includes second and third pneumatic actuators 91 and 93. The first pneumatic actuator 91 is mounted on an arm 95 affixed to the inner side of one end wall 23. The arm extends upwardly and outwardly generally along an axis transverse to the longitudinal axis of the upper and lower finger dies 43 and 45. Mounted atop the upper surface of the arm 95, near the outer tip thereof, is a third pneumatic actuator yoke 97. The third pneumatic actuator yoke 99 includes a spaced pair of upwardly projecting arms 99. A flange 103 projecting longitudinally outwardly from the non-shaft end of the second pneumatic actuator 91 is pinned to the arms 99 of the third pneumatic actuator yoke 97 by a pin 105. A shaft 107 projects outwardly from the non-flange end of the second pneumatic actuator 91 and includes a cylindrical collar 108 at its outer end. The collar 108 is rotatably attached by a pin 109 to the adjacent circular disc 47, as best illustrated in FIG. 3. The pinning of the second pneumatic actuator to the arms 99 and the collar 108 to the circular disc 47 is such that the extension and retraction of the shaft due to the application of pneumatic pressure on one side or the other of the piston mounted in the cylinder of second pneumatic actuator 91 causes the cylindrical disc 47 to rotate. Rotation of the cylindrical disc 47, in turn, causes rotation of the upper die 43.

The third pneumatic actuator 93 is mounted on an arm 111 affixed to the outer surface of one wall 23. The arm 111 projects transversely outwardly and downwardly with respect to the longitudinal axis of the dies. A fourth pneumatic actuator yoke 113 is mounted atop the outer end of the arm 111 and includes a spaced pair of upwardly projecting arms 115. A flange 117 projects outwardly from the non-shaft end of the third pneumatic actuator 93 and is pinned by a pin 121 to the arms 115 of the fourth pneumatic actuator yoke 113. A fifth pneumatic actuator yoke 124 is attached to the outer end of the shaft 123 of the third pneumatic actuator 93. The fifth pneumatic actuator yoke is rotatably pinned to an arm 125 by a pin 126. The arm, in turn, is affixed to one of the shafts 83 projecting outwardly from either end of the second die 45. The pinning is such that the application of pneumatic pressure to either side of the piston mounted in the cylinder of the third pneumatic actuator 93 and the subsequent movement of its shaft 123 causes the arm 125 to move back and fourth. Movement of the arm 125 back and fourth causes the lower or second die 45 to rotate.

A rotation limit stop arm 127, affixed to the horizontal wall of the angle plate 85 of the stop mechanism, so as to extend between the bracket 85 and the associated frame wall 23 or 25 is provided to limit the amount of rotational movement of the second die 45. If desired, the stop arm 127 may support a threaded bolt (not shown), such as the threaded bolts 89 forming part of the die transverse positioning assembly, so that a wide variety of rotation control stops can be set.

It will be appreciated from the foregoing description that mechanisms for rotating either die and a mechanism for transversely positioning the lower die with respect to the upper die are provided by the invention. The following description will describe the nature and operation of the table assembly 19.

The table assembly 19 includes: a lower horizontal plate 131, an upper horizontal plate 133; and, a pair of vertical sidewalls 135 and 137. The vertical sidewalls 135 and 137 are affixed to the upper and lower plates 133 and 135, by welding, for example. Thus, the upper and lower horizontal plates 133 and 135 are maintained in fixed space relationship, and this overall housing structure forms an open-ended box. The open ends of this structure lie along an axis that is transverse to the longitudinal axis defined by the upper and lower dies 43 and 45.

The lower horizontal plate 131 includes a point 139 at one end. The lower surface of the pointed end of the lower plate 131 is coplanar with the upper surface of the inverted U-shaped base 21. A first bolt 141, loosely passing through apertures in the pointed end of the lower plate 131 and the adjacent region of the base 21, couples the lower plate 131 to the base 21. An arcuate slot 143 located on a radius of the aperture through which the first bolt 141 passes, and above the base 21, is formed in the lower plate 131. A second bolt 145 passes through the arcuate slot 143 and a circular aperture in the base 21. It will be appreciated that this arrangement allows the lower plate 131 to be horizontally moved back and forth through an arc defined by the length of the arcuate slot 143, with the axis of rotation defined by the longitudinal axis of the first bolt 141. Further, since the upper plate 133 is affixed to the lower plate 131, via the first and second walls 135 and 137, the entire table housing structure, and the hereinafter described elements affixed thereto, is horizontally rotatable. The horizontal rotation allows this structure to be moved from a position whereat the table's longitudinal axis is orthogonal to the longitudinal axis of the first and second dies 43 and 45 to a multitude of positions whereat the table's longitudinal axis lies transverse to the longitudinal axis of the first and second dies.

Figure 2:
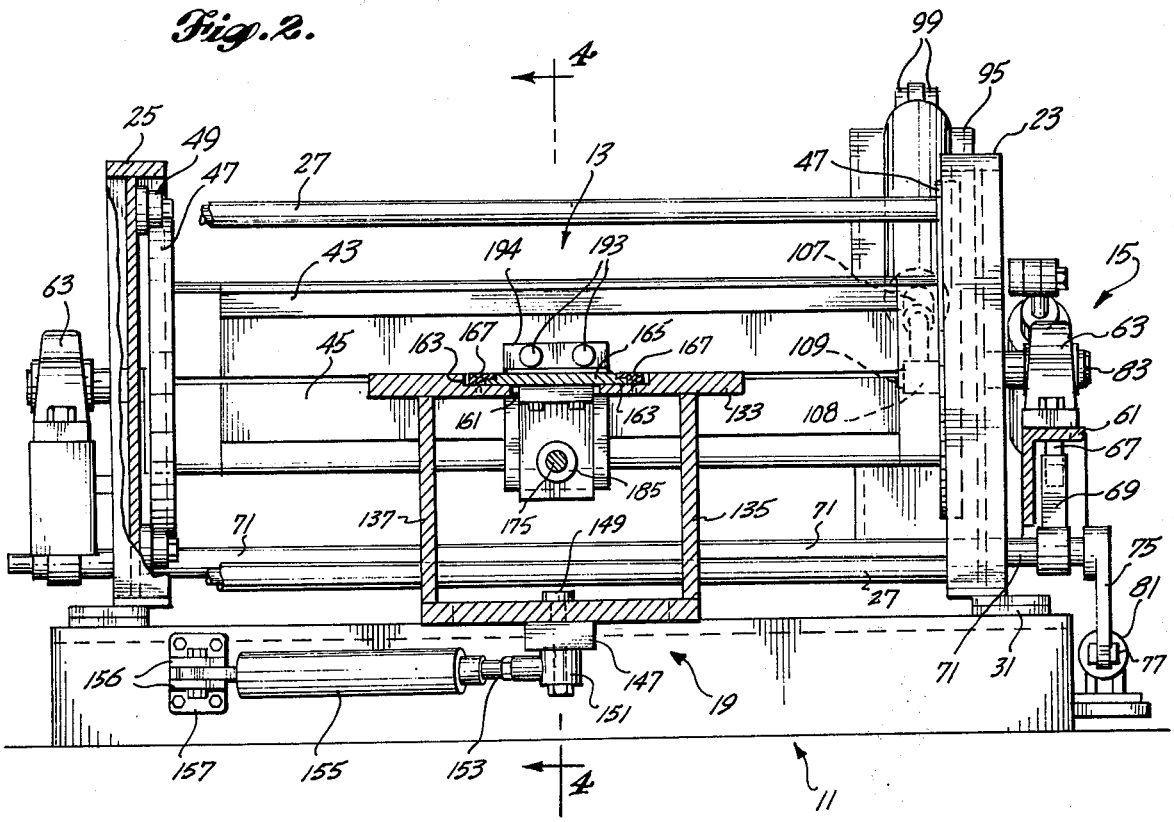
FIG. 2 is a front elevational view, partially in section, of the preferred embodiment of the invention illustrated in FIG. 1.

As best illustrated in FIG. 4, projecting downwardly from the lower surface of the lower plate 131, beyond the adjacent edge of the base 21, is a spacing collar 147 through which a vertical pin 149 projects. The vertical pin 149 also passes through the lower plate 131 and includes a head that lies atop the lower plate. The vertical pin 149 passes through a collar 151 attached to the shaft 153 of a fourth pneumatic actuator 155. A flange projecting from the non-shaft end of the cylinder of the fourth pneumatic actuator 155 is vertically pinned to a pair of arms 156 forming part of a sixth pneumatic actuator yoke 157 (FIG. 2). The sixth pneumatic actuator yoke 157 is attached to the adjacent edge of the base 121, near one end thereof. Thus, the shaft 153 of the fourth pneumatic actuator 155 is position adjustable in a horizontal plane by control of the pressure applied to the sides of the piston housed in the cylinder of the fourth pneumatic actuator 155. Controlling the position of the shaft 153, in turn, controls the horizontal arcuate position of the lower plate 131 and, hence, the table.

The upper plate 133 includes a rectangular aperture 161 having its longitudinal axis located transverse to the longitudinal axis of the first and second dies 43 and 45. As best seen in FIG. 2, upper undercut regions 163 are formed along both of the longitudinal edges of the rectangular aperture 161. Lying atop the lips formed by the undercut regions is a transversely movable slide 165. The lateral edges of slide 165, lying above the lips formed by the undercut regions 161 are also undercut along the top. Elongate right angle brackets 167 are mounted on either side of the lateral edges of the slide 165 and include inwardly extendly arms that extend over the undercut lateral edges of the slide 165. The elongate right angle brackets are attached to the upper plate by bolts or cap screws. In this manner, slots, within which the outwardly extending lateral lips of the slide 165 are adapted to slide, are formed. The lip slots allow the slide to move horizontally back and fourth along the longitudinal axis of the table slot 161 only.

Mounted on an end flange 169, extending downwardly from the lower surface of the upper plate 133, at the outer edge thereof, is a stepping motor 171. The stepping motor 171 is mounted such that its shaft axis is horizontal and parallel to, but beneath, the longitudinal axis of the table slot 161. Affixed to the shaft 173 of the stepping motor 171 so as to project axially outwardly therefrom, beneath the table slot 161, is a threaded shaft 175. The end of the theaded shaft 175 nearest the stepping motor 171 is rotatably supported by a bearing 179 mounted in an outer flange 177 extending downwardly from the lower surface of the upper plate 133. Similarly, the other end of the threaded shaft 175 is supported by a bearing 183, mounted in an inner flange 181 extending downwardly from the lower surface of the upper plate 133. A coupler 184 couples the threaded shaft 175 to the shaft 173 of the stepping motor 171. A threaded cylindrical nut 185 is mounted on the threaded portion of the threaded shaft 175, and affixed to a downwardly extending slide flange 187. The slide flange 187 is affixed to the underside of the slide 165.

It will be appreciated from the foregoing description that, as the stepping motor 171 is energized so as to step rotate its shaft 173, the threaded shaft 175 also is stepped. As the threaded shaft 175 is stepped, the cylindrical nut 185 (which is prevented from rotating with the threaded shaft 175 due to its connection to the slide 165) moves back and forth along the longitudinal axis of the threaded shaft 175. This movement is transferred via the slide flange 187 to the slide 165, whereby the slide 165 is moved transversely back and forth, with respect to the longitudinal axis of the upper and lower finger dies 43 and 45.

The edge region of the slide 165 nearest the finger dies 43 and 45 forms the lower jaw of a clamp 188. The upper jaw of the clamp 188 is formed by clamp plate 189 superimposed above the lower jaw. The clamp plate 189 is spaced slightly above the slide 165 and is horizontally, rotatably attached thereto so that the edges of the jaws nearest the finger dies are vertically movable toward and away from one another. The horizontal axis of rotation is transverse to the axis of movement of the slide 165 and lies between the jaws and a rear upwardly diverging flange 190 forming part of the clamp plate 189. The rear upwardly diverging flange 190 lies atop a pair of wedge-shaped control elements 191. The wedge-shaped control elements are connected to the outer ends of shafts 192 that form or are attached to the movable slugs of a pair of solenoids 193. The solenoids are attached to a bracket 194 mounted atop the slide and positioned such that their slugs move in paths running parallel to the direction of movement of the slide. When the slugs move the wedges toward the finger dies, the inclined surfaces of the wedges impinge on the diverging flange of the clamp plate 189 causing it to rotate, whereby the jaws close. In this manner, an electromechanical clamp is provided to hold the outer edge of sheet metal parts as they are moved between the dies. Preferably, the jaw edge of the slide 165 is transversely undercut along its entire length and the adjacent region of the jaw edge of the clamp plate 189 includes a complementary protrusion 195. This undercut/complementary protrusion arrangement results in accurate control of the longitudinal position of the metal parts with respect to the slide 165. Thus, the outer edge of the parts are exactly positioned with respect to the step controlled position of the threaded shaft.

In operation, the slide 165 is first withdrawn to a position near the stepping motor 171. Then, a part is inserted in the jaws. Thereafter, the stepping motor is energized and steps the part toward the finger dies. The part slides between the upper and lower dies to a first bending position. Thereafter, one of the dies (which one will depend on the direction of bend as hereinafter described) is rotated and the part is bent. After the appropriate die is rotated, the part may be inserted further by energizing the stepping motor 171 again and a second bend formed with or without a change in the transverse position of the dies.

FIGS. 6A and 6B illustrate the cross-sectional configuration of one form of finger dies formed in accordance with the invention. Basically, each die includes an elongate support 201 and an elongate exchangeable finger die element 203 attachable thereto. The supports 201 include a stepped side 205 to which the finger die elements 203 are attached by a series of cap screws 207.

The cross-sectional configuration of the supports is generally, but not exactly, rectangular. The side 209 of the supports, remote from the stepped side 205, lies generally parallel to the steps defined by the stepped side. One transverse side, identified as the outer transverse side 211, lies generally orthogonal to the stepped side 205. The other side, defined as the inner transverse side 213, forms an obtuse angle with the remote side 209. After extending a distance slightly greater than one-half the distance between the stepped side and the remote side 209, the inner transverse side 213 curves toward the stepped side 205 for a predetermined distance. The curve region terminates in a straight section that intersects the stepped side 205 at an obtuse angle. The axis of rotation of the overall die structure is located at the center of the radius of curvature of the curved region. The supports 201 are mounted such that the inner transverse sides 213 face one another. They are also mounted such that, when the inner transverse sides are aligned the supports become aligned mirror images of one another.

The die elements 203 each include a stepped side that mate with the stepped sides of the elongate supports 201. However, the stepped sides of the die elements are narrower than the stepped sides of the supports such that the portion of the supports in the curved regions extend beyond the adjacent regions of the finger die elements. The die elements 203 each include finger regions 215 formed in the manner next described.

Starting at the point where the stepped sides of the die elements are set back with respect to the stepped sides of the supports 201, the wall of the die element first extends orthogonally with respect to the stepped sides. Next the orthogonal wall 214 makes an orthogonal turn toward the opposite die. The wall then curves outwardly through an arc having a radius of curvature equal to the desired radius of curvature of the resultant finger 215. The curve starts at a point that causes the outer tip of the curve to be slightly spaced from the plane defined by the inner transverse side 213 of the support. The curve extends through 180° and terminates in an outer wall 216 that extends to a point where the outer wall 216 becomes aligned with the orthogonal wall 214 of the die element. At this point the outer wall bends toward the other end of the stepped side of the die element, finally curving until it meets that side. The open region lying between the finger 215 and the outer projection of the support 201 (in the curved region) is herein defined as the palm region 217 of the finger die.

As previously discussed, the transverse position of the second die 45 with respect to the first die 43 is adjustable. The adjustment is such that the finger of either die can be made to align with the palm of the other die. In this regard, in FIG. 6A, the finger of the lower die 45 is aligned with the palm 217 of the upper die 43. Conversely, in FIG. 6B, the finger 215 of the upper die 43 is aligned with the palm 217 of the lower die 45. Which type of alignment exists determines which of the two dies is to be rotated and the direction of the resultant bend. In all cases the palm die is rotated. Thus in FIG. 6A the upper die is rotated from its solid line position to a position whereat the desired bend is achieved, up to the illustrated dotted line position if a right angle bend is desired. Such rotation causes the portion of the metal part 219 extending beyond the upper and lower dies along the edge remote from the table to be rotated downwardly. In FIG. 6B, the lower die is rotated while the upper die remains fixed and this portion of the metal part 219 is bent upwardly. Changing of the transverse displacement position of the lower die 45 between bends results in a Z-shaped structure being formed. As noted above, obviously, the angle of bend is determined by the angle through which the palm die is rotated. Consequently, while right angle bends are illustrated in FIGS. 6A and 6B, bends other than right angle bends can be formed by the invention. Moreover, the lower die does not have to be transversely moved from one position to the other position, unless Z-shaped bends are desired. If the lower die is not moved, bends in the same direction can be sequentially formed. The angulation of such bends is only limited by the shape of the outer surface of the die elements beyond the finger.

The dies illustrated in FIG. 7 are generally similar to the dies illustrated in FIGS. 6A and 7B, except that the finger die elements 221 are smaller whereby the radius of curvature of the resultant bends is smaller. More specifically, the radius of curvature of the fingers of the die elements determines the radius of curvature of the resultant bend. In FIG. 7, the radius of curvature of the fingers 222 is substantially smaller than is the radius of curvature of the die elements illustrated in FIGS. 6A and 6B. In addition, the palms 223 are generally smaller, due to the fingers being closer to the elongate supports 201. The smaller size of these regions (i.e., fingers and palms) results in the radius of curvature of the resultant bends being smaller.

FIG. 8 is a block diagram illustrating a control system for controlling the operation of the mechanical bending system illustrated in FIGS. 1–7. The control system illustrated in FIG. 8 includes: an N/C controller 225; the stepping motor 171; first, second, third and fourth electropneumatic valves 227, 229, 305, 231 and 233; a pneumatic source 235; the first transverse position pneumatic actuator 81; the second or upper die rotation pneumatic actuator 91; the third or lower die rotation pneumatic actuator 93; the fourth or table position actuator 155; and, the jaw solenoids 193.

As will be appreciated by those skilled in the machine control system art and others, an N/C controller is a device for reading a numerical control tape, cards or other source of machine control signals. The N/C controller, in accordance with these signals, generates analog and/or digital control signals, as necessary, that are used to control the positioning of actuation devices, such as pneumatic actuators and stepping motors, for examples.

The N/C controller 225 is electrically connected to the stepping motor 171 so as to apply stepping control signals thereto. The N/C controller also receives position signals generated by the stepping motor 171. The N/C controller is also electrically connected to the jaw solenoids 193.

The N/C controller is further electrically connected to the first, second, third and fourth valves 227, 229, 231 and 233. In accordance with the electrical control signals they receive, these valves control the application of pneumatic pressure produced by the pneumatic source 311 to the sides of the pistons housed in the cylinders of the pneumatic actuators. More specifically, the first valve 227, in addition to being connected via conduit to the pneumatic source 235, is also connected to via conduit the cylinder of the upper die rotation actuator 91. The second valve 229, in addition to being connected via conduit to the pneumatic source, is also connected to the cylinder of the lower die rotation actuator 93. Similarly, the third and fourth valves 231 and 233, in addition to being connected to via conduit the pneumatic sources 235, are also connected to the cylinders of the transverse position actuator 81 and the table position actuator 155, respectively.

In operation, subsequent to placing a metal part to be bent between the jaws of the table, illustrated and discussed above, the N/C controller is started. First, the N/C controller energizes the jaw solenoids 193 to clamp the part. Then, the N/C controller energizes the stepping motor 171 and the part is moved to a first position between the dies. At the same time, or thereafter, the transverse position actuator 81 is pneumatically energized by the third valve 231 to move the lower die to the desired transverse position. Also simultaneously (or thereafter, or previously) the table position actuator 155 is actuated to move the table to the desired angular position with respect to the longitudinal axis of the dies. After the part, table and lower die are positioned, the appropiate die is rotated through the distance necessary to achieve the desired bend. Thereafter, the rotated die is returned to its idle position, the part, lower die and table are repositioned, as necessary, and the part is bent again. Alternatively, if only a single bend is to be made, the jaw solenoids are de-energized and part is removed after the single bend is made. In any event, this sequence is repeated, as necessary, until the desired number of bends are made. Then the part is removed from between the dies.

It will be appreciated from the foregoing discussion that the invention provides a new and improved sheet metal bender. Because three points of impingement on the part occur during the bending of a part, little or no force is applied to the portion of the part lying between the jaws. Hence, very little jaw force is required. Moreover, because only a portion of the part is actually moved during bending, the part movement problem related to brake press bending is eliminated; i.e., the invention is safer. Further, the invention provides a bender that can more readily make multiple bends, and does so without requiring that a part be inverted to obtain a reverse bend. Further, the three-point bending load technique results in uniform bending radii and small part movement with respect to the die. Small part movement results in decreased marking of the surface of the part in the bend region. Hence, the invention overcomes many of the disadvantages of prior art benders, discussed above.

The invention can be either operated manually or in an automatic fashion, utilizing an N/C control system of the type illustrated in FIG. 8. In this regard, mechanical arms can replace the pneumatic actuators to provide a mechanism for transferring manual force to the various elements to be moved. Also, while pneumatic actuators have been described as a means for providing the forces necessary to move various mechanisms, other actuators can be utilized, if desired—hydraulic actuators, for example. Still further, while a single set of die position and rotation pneumatic actuators, located on one wall of the frame, have been illustrated and described, if desired, a complementary set of actuators located on the other wall can be included if it is necessary or desirable to apply force to both ends of the dies during transverse movement of the lower die and rotation of either die. Thus, while a preferred embodiment of the invention has been illustrated and described, it will be appreciated by those skilled in the art and others, that various changes can be made therein without departing from the spirit and scope of the invention.

The embodiments of the invention in which an exclusive property or privilege is claimed are defined as follows:

1. A three-point, air-bending sheet metal bender comprising:

a first elongate, U-shaped finger die, one leg of said U-shape forming a finger region and the aperture of said U-shape forming a palm region;

a second elongate, U-shaped finger die, one leg of said U-shape forming a finger region and the aperture of said U-shape forming a palm region; and, support and rotation means for: (i) supporting said first and second elongate, U-shaped finger dies in parallel, spaced relationship such that the finger regions of said finger dies generally face one another, and such that the finger region of one of said first and second finger dies is aligned with the palm region of the other of said first and second finger dies, said first and second finger dies being spaced such that a sheet of metal can be positioned between the finger and palm regions of said first and second finger dies such that the finger and palm region of one of said dies lie on one side of said sheet of metal in close proximity thereto and the finger and palm region of the other of said dies lie on the other side of said sheet of metal in close proximity thereto; and, (ii) rotating said die whose palm region is aligned with the finger region of the other die in a manner such that said palm region rotates about said finger region.

2. A three-point, air-bending sheet metal bender as claimed in claim 1 including die position translation means affixed to one of said first and second finger dies for translating said one of said first and second finger dies in a direction transverse to the longitudinal axis of said first and second finger dies between a position whereat the finger region of said first finger die is aligned with the palm region of said second finger die and a position whereat the finger region of said second finger die is aligned with the palm region of said first finger die.

3. A three-point, air-bending sheet metal bender as claimed in claim 2 wherein said support and rotation means comprises:

a frame, said frame including at least a pair of spaced parallel walls;

first and second discs mounted for rotation on the facing planar surfaces of said first and second walls, in alignment with one another, said first finger die being mounted between said first and second discs such that the longitudinal axis of said first finger die lies transverse to the planes defined by said discs, said discs including aligned arcuate apertures;

a first disc rotation mechanism attached to at least one of said discs for rotating said disc and said first finger die;

support means for supporting said second finger die for rotation and such that said second finger die passes through said aligned arcuate apertures in said discs; and, a second die rotation mechanism attached to said second finger die for rotating said second finger die.

4. A three-point, air-bending sheet metal bender as claimed in claim 3 wherein:

A. said support means for supporting said second finger die comprises a pair of hubs one located beyond the outer surface of each of said pair of spaced walls, said second finger die being rotatably mounted in said hubs; and, B. said die position translation mechanism comprises:

1. first and second shelves one attached to the outer surface of each of said pair of spaced walls so as to support said first and second hubs for movement in a direction transverse to the longitudinal axis of said second finger die; and,
2. translation movement means attached to at least one of said hubs for moving said hubs and said second finger die in a direction transverse to the longitudinal axis of said second finger die.

5. A three-point, air-bending agent sheet metal bender as claimed in claim 4 wherein said first and second die rotation mechanisms, and said translation movement means each include pneumatic cylinders having their shafts connected, respectively, to: one of said discs; said second finger die; and, at least one of said hubs.

6. A three-point, air-bending sheet metal bender as claimed in claim 5 including a table having a planar top lying generally coplanar with the space between said first and second finger dies wherein a sheet of metal can be positioned.

7. A three-point, air-bending sheet metal bender as claimed in claim 6 including a sheet metal movement mechanism for moving a piece of sheet metal lying atop the planar top of said table along a path transverse to the longitudinal axis of said first and second finger dies through the space between said first and second finger dies wherein a sheet of metal can be positioned.

8. A three-point, air-bending sheet metal bender as claimed in claim 7 wherein said sheet metal movement mechanism includes a clamp for clamping a piece of sheet metal at a predetermined position along said path transverse to the longitudinal axes of said first and second finger dies.

9. A three-point, air-bending sheet metal bender as claimed in claim 8 wherein said sheet metal movement means includes a slide means mounted in the planar top of said table and a stepping motor mounted on said table and moving a shaft connected to said slide means for moving said slide in a direction transverse to the longitudinal axis of said first and second finger dies, said clamp forming part of said slide means.

10. A three-point, air-bending sheet metal bender as claimed in claim 9 including a table movement mechanism connected to said table for moving said table through an arc from a position whereat said path of movement of said sheet of metal lies generally orthogonal to the longitudinal axis of said first and second finger dies to positions whereat said path of movement lies along axes that are non-orthogonal to the longitudinal axis of said first and second finger dies.

11. A three-point, air-bending sheet metal bender as claimed in claim 10 including an N/C control system for controlling:

a. the rotation of said first finger die;
b. the rotation of said second finger die;
c. the translation movement of said second finger die with respect to said first finger die;
d. the operation of said stepping motor;
e. the arcuate movement of said table; and,
f. the clamping action of said clamp.

12. A three-point, air-bending sheet metal bender as claimed in claim 2 including a table having a planar top lying generally coplanar with the space between said first and second finger dies wherein a sheet of metal can be positioned.

13. A three-point, air-bending sheet metal bender as claimed in claim 12 including a sheet metal movement mechanism for moving a piece of sheet metal lying atop the planar top of said table along a path transverse to the longitudinal axes of said first and second finger dies through the space between said first and second finger dies wherein a sheet of metal can be positioned.

14. A three-point, air-bending sheet metal bender as claimed in claim 13 wherein said sheet metal movement mechanism includes a clamp for clamping a piece of sheet metal at a predetermined position along said path transverse to the longitudinal axes of said first and second finger dies.

15. A three-point, air-bending sheet metal bender as claimed in claim 14 wherein said sheet metal movement means includes a slide means mounted in the planar top of said table and a stepping motor mounted on said table and having a shaft connected to said slide means for moving said slide in a direction transverse to the longitudinal axes of said first and second finger dies, said clamp forming part of said slide means.

16. A three-point, air-bending sheet metal bender as claimed in claim 15 including a table movement mechanism connected to said table for moving said table through an arc from a position whereat said path of movement of said sheet of metal lies generally orthogonal to the longitudinal axes of said first and second finger dies to positions whereat said path of movement lies along axes that are non-orthogonal to the longitudinal axis of said first and second finger dies.

17. A three-point, air-bending sheet metal bender as claimed in claim 2 including an N/C control system for controlling:

a. the rotation of said first finger die;
b. the rotation of said second finger die; and,
c. the translation movement of said second finger die with respect to said first finger die.

18. A three-point, air-bending sheet metal bender as claimed in claim 1 wherein said support and rotation means comprises:

a frame, said frame including at least a pair of spaced parallel walls;

first and second discs mounted for rotation on the facing planar surfaces of said first and second walls, in alignment with one another, said first finger die being mounted between said first and second discs such that the longitudinal axis of said first finger die lies transverse to the planes defined by said discs, said discs including aligned arcuate apertures;

a first disc rotation mechanism attached to at least one of said discs for rotating said disc and said first finger die;

support means for supporting said second finger die for rotation and such that said second finger die passes through said aligned arcuate apertures in said discs; and, a second die rotation mechanism attached to said second finger die for rotating said second finger die.

19. A three-point, air-bending sheet metal bender as claimed in claim 18 wherein said first and second die rotation mechanisms each include pneumatic cylinders having their shafts connected, respectively, to: one of said discs; and, said second finger die.

* * * * *

UNITED STATES PATENT AND TRADEMARK OFFICE

CERTIFICATE OF CORRECTION

PATENT NO. : 4,043,165

DATED : August 23, 1977

INVENTOR(S) : Badger et al

It is certified that error appears in the above-identified patent and that said Letters Patent are hereby corrected as shown below:

Column 7, line 49, delete "extendly" and insert --extending--;

line 55, delete "fourth" and insert --forth--.

Column 10, line 41, delete "305";

line 67, delete "311" and insert --235--.

Column 11, line 9, delete "sources" and insert --source--.

Column 13, line 20 (Claim 5, line 1) delete "agent".

Column 13, line 47 (Claim 9, line 5) delete "moving" and insert --having--.

Column 14, line 25 (Claim 15, line 7) delete "axes" and insert --axis--.

Column 14, line 32 (Claim 16, line 6) delete "axes" and insert --axis--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*